US006082866A

United States Patent [19]

Amedee

[11] Patent Number: 6,082,866

[45] Date of Patent: Jul. 4, 2000

[54] ILLUMINATED COASTER

[76] Inventor: Jacob L. Amedee, 2827 Bos Bettes Rd., Marietta, Ga. 30066

[21] Appl. No.: 09/396,509

[22] Filed: Sep. 15, 1999

[51] Int. Cl.[7] ..... F21K 2/06

[52] U.S. Cl. ..... 362/34; 362/101; 362/806

[58] Field of Search ..... 362/34, 101, 253, 362/318, 806; 248/346.11

[56] References Cited

U.S. PATENT DOCUMENTS

| | | | |
|---|---|---|---|
| 4,336,574 | 6/1982 | Goodman | 362/101 |
| 5,010,461 | 4/1991 | Saotome | 362/101 |
| 5,056,749 | 10/1991 | Ige | 248/346.1 |
| 5,171,081 | 12/1992 | Pita et al. | 362/34 |
| 5,624,177 | 4/1997 | Rosaia | 362/101 |
| 5,695,270 | 12/1997 | Collet | 362/34 |
| 5,709,449 | 1/1998 | Kuo | 362/34 |

*Primary Examiner*—Y. Quach
*Attorney, Agent, or Firm*—William B Noll

[57] ABSTRACT

An illuminating coaster assembly for removable attachment to an essentially flat bottomed, transparent beverage container to highlight a selected drink, particularly for use in a dark room or bar. The assembly comprises a generally circular housing having an opaque bottom wall, an opaque peripheral side wall, and an essentially planar, light transmitting top wall. The light transmitting top wall concentrically mounts an opaque center member spaced inwardly from the peripheral side wall, and an adhesive layer overlying at least a portion of the center member for removably securing the coaster assembly to the beverage container. To effect illumination of the assembly, the housing contains a chemical illuminating material that is activated by mixing through vigorous shaking.

5 Claims, 1 Drawing Sheet

ILLUMINATED COASTER

FIELD OF THE INVENTION

This invention is directed to the field of chemically activated illuminating devices, more particularly to an illuminated coaster suitable for use in a dark bar or grill for highlighting one's drink.

BACKGROUND OF THE INVENTION

The present invention relates to an illuminated coaster assembly that is free of an electrical power source for illumination. The illumination is achieved by chemical reaction, as more clearly explained later.

The prior art offers a number of illuminated articles of manufacture, some of which are useful as a beverage coaster. However, none teach the simplicity and uniqueness of the present invention. The most pertinent prior art is reflected in the following U.S. Patents:

a.) U.S. Pat. No. 5,709,449, to Kuo, teaches a system for illuminating a transparent body having two separate chambers containing different liquids which are mixed together when a guide tube is pressed to provide communication between the chambers, and the body is shaken.

b.) U.S. Pat. No. 5,695,270, to Collet, discloses a chemiluminscent coaster including a coaster combined with a luminous filler or light source, structured as a shell containing reagents for inducing chemiluminescence. At least one surface of the coaster is light transmissive, being wholly or partially transparent or translucent. A single-use chemiluminescent coaster may use light sources in which the reaction takes place extemporaneously at the time of use, or may include light sources wherein pre-mixed reagents are kept at −40 degrees C. in order to prevent any chemiluminescent reaction. Reusable chemiluminscent coasters preferably use extemporaneously chemiluminescent sources. The coaster is structured to permit expansion due to gaseous discharge during the chemiluminescent reaction. A surface thereof may include an opening to permit dilation of the shell, or may be made at least partially of a supple, expandable, material. In the later case, a raised edge may be provided at the periphery of a supple bottom surface, to permit the coaster to rest flatly on the raised edge whether or not the surface is expanded.

c.) U.S. Pat. No. 5,624,177, to Rosaia, relates to an illuminated circular ring which provides lumination to various style drinking glasses. This ring is attachable or interdesigned into various style drinking glasses providing a housing for an integrated circuit board with state of the art surface mount solid state components. The components are attached to an interchangeable cover.

d.) U.S. Pat. No. 5,171,081, to Pita, et al., teaches a vessel for the containment of food or drink which produces a chemiluminescent reaction when activated to provide an enjoyable effect for the user of the vessel. The vessel has inner and outer walls and floors with a space therebetween, and includes a chemiluminescent fluid within at least the floor space. Another chemiluminescent fluid is contained separately within a toroidal tube in the upper or lower rim of the vessel. The vessel and tube are preferably formed of a flexible and translucent plastic. Thus, when the rim is flexed the toroidal tube is compressed, causing the fluid contained therein to rupture a thin membrane separating the volumes of the tube and wall or floor space and allowing the fluid contained within the tube to flow into the space between the two walls and floors to mix with the other chemiluminescent fluid and thereby produce an interesting and pleasing glow from the vessel. A further variation on the above invention provides for containment of one of the fluids in a capsule in the base of the container. While a specific combination of chemicals known in the art is disclosed, a variety of chemiluminescent compounds may be used to provide different colors, brightness, reaction times, etc, e.) U.S. Pat. No. 5,056,749, to Ige, discloses a removable coaster for attachment onto a receptacle such as a cup, for example, having a hole on the coaster bottom for easy removal thereof. The coaster has a circumference less than the circumference of the receptacle in order to force fit the coaster onto the bottom portion of the receptacle so that the wall of the coaster is flush with the wall of the receptacle.

f.) U.S. Pat. No. 5,010,461, to Saotome, relates to a display platform for exhibiting an object by illuminating the object in a selectable plurality of color and/or color patterns. The illuminating source is activated by a pressure-sensitive switch which will engage only if an object of sufficient mass is placed on the pressure sensitive switch. Variation of illuminating color or pattern is accomplished by a sequentially registrable filter disk that is placed between the illuminating source and the object to be displayed. The electrical power supply that energizes the illuminating source located within the platform.

g.) U.S. Pat. No. 4,336,574, to Goodman, teaches a lighted coaster for supporting beverage containers such as glasses. The coaster includes a top cover having a translucent lens and a side skirt extending downwardly to overlap a base member. The base contains batteries and a springbiased light bulb extending upwardly to contact the underside of the lens in such a fashion that when beverage glasses are placed on the coaster, the light moves downwardly to contact a suitably disposed circuit member and actuate the light. When the beverage is removed, the light urges the cover upwardly a short distance and breaks contact with the electric circuit and turns itself off.

None of the prior art articles of manufacture described above teach a self illuminating coaster assembly that may be readily adhered to a beverage vessel in the manner taught by the present invention. The simplicity, though effectiveness, of the coaster assembly hereof will become more apparent in the following specification.

SUMMARY OF THE INVENTION

The present invention, in a preferred embodiment, is directed to an illuminating coaster assembly for removable attachment to an essentially flat bottomed, glass, beverage vessel. The coaster assembly comprises a generally circular housing having an opaque bottom wall, an opaque peripheral side wall, and an essentially planar transparent top wall. The transparent top wall concentrically mounts an opaque center member spaced inwardly from the peripheral side wall. Overlying at least a portion of the coaster member is an adhesive layer for removably securing the coaster assembly to the beverage vessel. Contained within the housing is a chemical illuminating material, activated by mixing through vigorous shaking, to emit light through the beverage vessel.

Accordingly, a principal object of this invention is the provision of a portable, throwaway, chemically activated light emitting coaster assembly for a beverage vessel.

Another object hereof is the convenient means to highlight an individual's drink, particularly in a dark room or bar.

A further object of the invention is the provision of an adhesive layer to removably secure the coaster assembly to a beverage vessel.

Still another object hereof is the provision of a coaster assembly housing having a transparent top featuring an opaque central portion, so as to concentrate the emitting light in a circular ring.

These and other objects will become apparent to those skilled in the art from the following description, particularly when read in conjunction with the accompanying drawings.

DETAILED DESCRIPTION OF PREFERRED EMBODIMENT

Figure 1:
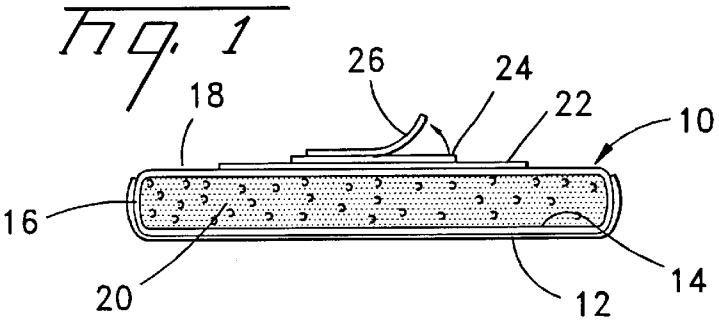
FIG. 1 is a sectional view taken across the illuminating coaster assembly according to the present invention.

This invention relates to an illuminated coaster assembly that is illuminated through a chemical reaction of products activated by mixing such products through vigorous shaking. The invention will now be described with regard to the several Figures, where like reference numerals represent like components or features throughout the various views.

Turning now to FIG. 1, there is shown in section a circular coaster housing 10, preferably molded of an opaque plastic, featuring a bottom wall 12, having a top surface 14, a peripheral side wall 16, preferably opaque, and a top wall 18 engagable with said peripheral side wall 16, to form a cavity 20 therewithin in communication with said top surface 14. The top wall 18, also preferably formed of plastic, is a light transmitting material, such as transparent, to allow illuminated light to pass therethrough as later explained.

Figure 3:
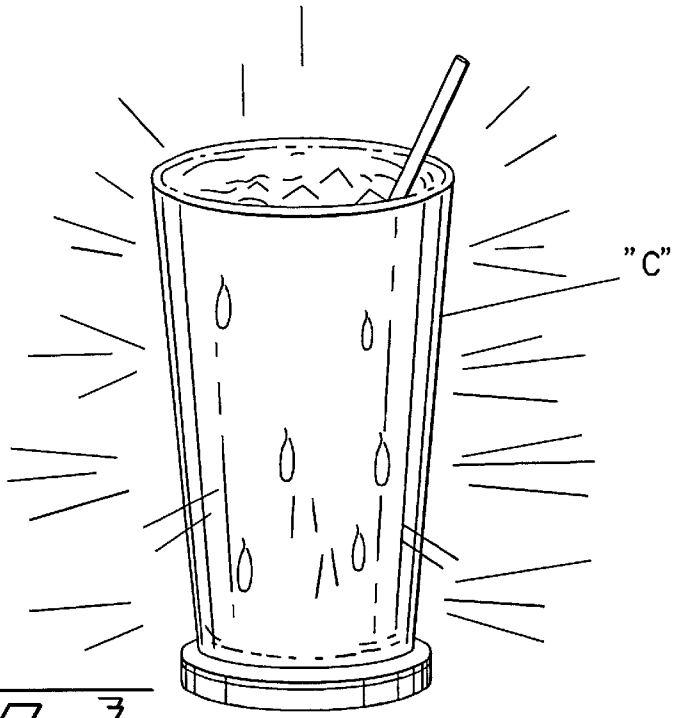
FIG. 3 is a perspective view of the combination of the illuminating coaster assembly of this invention secured to and emitting light through a glass beverage vessel.
Figure 2:
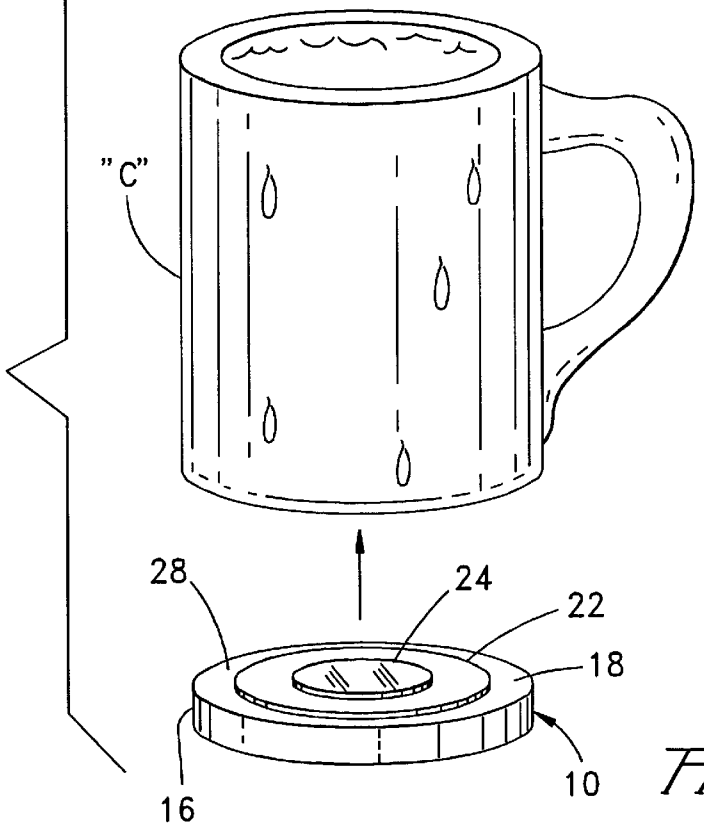
FIG. 2 is a perspective view of the illuminating coaster assembly hereof positioned for removable attachment to a beer mug, for example.

The top wall 18 features a concentrically mounted central opaque member 22 that is uniformity spaced inwardly from the peripheral side wall 16, see FIG. 2. Further, the central opaque member 22 is provided with a layer of adhesive 24 covering at least a portion of the central opaque member 22, and an overlying peelable film member 26. Since a major function of the coaster assembly hereof is to be removably affixed to a glass container "C", such as to the essentially flat bottom thereof, the film member 26 protects the adhesive layer 24 until one is ready to affix the coaster assembly 10 to the glass container "C". By this construction, a light transmitting ring 28 (FIG. 2) directly exposed to and through the bottom of the glass container "C". FIG. 3 illustrates the coaster assembly 10 affixed to a glass container "C".

Chemically reactive substances are well known in the art as reflected in the above prior art. The illuminescense may be produced by the reaction of an activator with a flourescent agent and an oxalate. For example, two liquids, when mixed to yield the desired illumination, may comprise oxalic acid and hydrogen peroxide; or, as an alternative, one chemical product may be in a solid crystalline form. Since the respective chemical products are maintained separately within the coaster housing 10 until ready for use, an active physical means is required to intermix the products. While various means to effect the intermixing, such as flexing, or breaking a sealed chamber, is known in the art, a preferred procedure is a vigorous shaking which is often sufficient to effect the desired mixing. As the illuminescence develops, the peelable protective film member 26 may be removed and the coaster assembly 10 directly affixed to the glass container "C", FIG. 3. To enhance and concentrate the illumination upward, the top surface 14 may be coated with a reflective layer, such as a silver or white paint.

It is recognized that variations, changes, and modifications may be made to the illuminated coaster assembly of this invention, particularly by those skilled in the art. Accordingly, no limitation is intended to be imposed on this invention, except as set forth in the appended claims.

I claim:

1. An illuminating coaster assembly for removable attachment to an essentially flat bottomed, transparent, beverage vessel, said coaster assembly comprising:

a.) a generally circular housing having an opaque bottom wall, an opaque peripheral side wall, and an essentially planar, light transmitting top wall;

i.) said light transmitting top wall concentrically mounting an opaque center member spaced inwardly from said peripheral side wall to expose a light transmitting ring thereabout; and, ii.) an adhesive layer overlying at least a portion of said center member for securing said coaster assembly to said beverage vessel; and, b.) a chemical illuminating material, activated by mixing through vigorous shaking, contained within said circular housing.

2. The illuminating coaster assembly according to claim 1, wherein said bottom wall includes a top surface having a light reflective coating thereon.

3. The illuminating coaster assembly according to claim 1, wherein a thin, peelable layer removably protects said adhesive layer prior to securing to said beverage vessel.

4. The illuminating coaster assembly according to claim 1, wherein said opaque center member is circular in configuration to expose a circular ring of said light transmitting top wall.

5. The illumninating coaster assembly according to claim 4, wherein said light transmitting top wall is transparent.

* * * * *